United States Patent [19]

Satter et al.

[11] 4,278,128

[45] Jul. 14, 1981

[54] PETROLEUM RECOVERY CHEMICAL RETENTION PREDICTION TECHNIQUE

[75] Inventors: Abdus Satter; Richard H. Widmyer; Yick M. Shum, all of Houston; Curtis E. Howard, Porter, all of Tex.

[73] Assignee: Texaco Inc., White Plains, N.Y.

[21] Appl. No.: 61,964

[22] Filed: Jul. 30, 1979

[51] Int. Cl.[3] ..... E21B 47/00; E21B 49/00

[52] U.S. Cl. ..... 166/250; 166/252

[58] Field of Search ..... 166/250, 252; 73/151, 73/155; 23/230 EP

[56] References Cited

U.S. PATENT DOCUMENTS

| | | | |
|---|---|---|---|
| 3,427,652 | 2/1969 | Seay | 73/151 X |
| 3,508,876 | 4/1970 | Polly | 166/252 X |
| 4,058,366 | 11/1977 | Cabbiness | 166/250 X |
| 4,090,398 | 5/1978 | Deans et al. | 166/250 X |
| 4,099,565 | 7/1978 | Sheely et al. | 166/252 |
| 4,168,746 | 9/1979 | Sheely | 166/252 |

OTHER PUBLICATIONS

Dalton et al., "Single-Well Tracer Method to Measure Residual Oil Saturation," SPE Paper No. 3792, 1972.

*Primary Examiner*—Stephen J. Novosad
*Assistant Examiner*—George A. Suchfield
*Attorney, Agent, or Firm*—Carl G. Ries; Robert A. Kulason; Jack H. Park

[57] ABSTRACT

The amount of a petroleum recovery chemical retained within a subterranean reservoir is predicted by first gathering data from at least one injection-soak-production cycle in a core wherein the produced fluids are monitored for both the chemical concentration in the produced fluid as well as the concentration of a nonabsorbing tracer and, second, utilizing this data in a chemical flood mathematical model to simulate at least one repetition of the injection-soak-production cycle. The simulated cycles are repeated until the simulated produced fluid concentration of the chemical is virtually the same as the actual produced fluid concentration of the nonabsorbed tracer. The amount of the chemical retained per unit of reservoir volume is then determined by conventional techniques.

9 Claims, 4 Drawing Figures

SURFACTANT AND TRACER CONCENTRATION PROFILES IN A CYCLIC TEST

SURFACTANT AND TRACER CONCENTRATION PROFILES IN A CYCLIC TEST

PRODUCED SURFACTANT RESPONSES
FOR CYCLIC RETENTION TEST

PRODUCED TRACER AND SURFACTANT RESPONSES FOR INTERMITTENT THROUGHPUT TEST

PETROLEUM RECOVERY CHEMICAL RETENTION PREDICTION TECHNIQUE

BACKGROUND OF THE INVENTION

1. Field of the Invention

This invention concerns an oil recovery process and more specifically is concerned with a method for predicting the amount of chemicals retained within a subterranean reservoir during the course of an oil recovery process.

2. Description of the Prior Art

The crude oil which has accumulated in subterranean reservoirs is recovered or produced through one or more wells drilled into the reservoir. Initial production of the crude oil is accomplished by a primary recovery technique wherein only the natural forces present in the reservoir, such as gas drive and natural water drive, are utilized to produce the oil. However, upon depletion of these natural forces and the termination of primary recovery, a large portion of the crude oil remains trapped within the reservoir. Also, many reservoirs lack sufficient natural forces to be produced by primary methods from the very beginning. Recognition of these facts has led to the development and use of many enhanced oil recovery techniques. Most of these techniques involve injection of at least one fluid into the reservoir to produce an additional amount of the crude oil therefrom.

Water flooding involves injection of water into the subterranean oil reservoir for the purpose of displacing the crude oil from the pore spaces of the reservoir rock towards the producing wells. It is the most economical and widely used of the enhanced oil recovery methods. Nevertheless, water does not displace oil with high efficiency because of the high interfacial tension between water and oil and because of the resulting immiscible displacement of oil by water.

Because of the inherent low efficiency of the basic water flooding method, the petroleum industry has for many years sought additional chemicals, which when added to a water fluid, will increase the efficiency of the water flooding method. A few of the chemicals which have been found useful for this purpose are surfactants, solubilizers, polymers, sacrificial agents, caustic additives and other reservoir conditioning agents.

The greater efficiency achieved by the addition of these chemicals to a water fluid is offset by the high cost of the chemicals themselves. In order for a petroleum recovery operation to be economically justifiable the value of the petroleum recovered by the process must, of course, exceed the cost of the recovery process itself. It is also known that most, if not all, of these chemicals are, to varying degrees, retained within the reservoir rock and are not to any large extent recoverable during the course of the petroleum recovery operation. To this end there is an substantial need to be able to accurately predict the amount of any such chemical that will be retained within the reservoir rocks during the course of the petroleum recovery operation. Knowledge of such an amount is crucial to the design of the chemical flood program.

Several different types of methods have been proposed for determining the chemical requirements for a chemical flooding program in which the amount of the chemical retained within the formation is determined. Such methods range in complexity from small scale laboratory bench testing of core materials to large scale multiwell pilot tests in the field. Unfortunately laboratory data are often unable to accurately predict chemical retention values under reservoir conditions due to the difficulties involved in translating information obtained from core flooding tests into information that is applicable to the immense heterogeneous reservoir rock volumes that comprise a typical petroleum reservoir. On the other hand, while a large scale multiwell pilot testing program will usually be able to provide fairly accurate chemical retention data, the costs involved in both expense and time in such programs are often prohibitive. In between these two methods fall methods involving only a single well to determine chemical retention data, bridging the gap between the laboratory and pilot floods. This type of procedure is attractive because a sufficiently large volume of reservoir is contacted to give meaningful results, and the results are usually able to be obtained within reasonable time and cost limits. One such technique is disclosed in the June 1967 issue of the *Journal of Petroleum Technology* in a paper by H. R. Froning and R. O. Leach entitled "Determination of Chemical Requirements and Applicability of Wettability Alteration Flooding."

SUMMARY OF THE INVENTION

This invention is a method for determining the amount of a chemical that is retained within a core undergoing a chemical flooding operation comprising:

(a) conducting a first injection-soak-production cycle in a core with a volume of a fluid which comprises the retained chamical and a non-retained tracer material;

(b) obtaining from a produced fluids concentration profile of the tracer the core volume contacted by the tracer and a dispersion parameter which describes the dispersion effects that take place for a non-retained material within the core;

(c) obtaining retention parameters for the retained chemical by utilizing dispersion data from step (a) and comparing the actual produced fluids concentration profile for the retained chemical with a simulated produced fluids concentration profile for the retained chemical obtained from a chemical flood mathematical model of the reservoir;

(d) conducting at least one more injection-soak production cycle in the core utilizing a fluid of the same volume and comprising the same concentration of the retained chemical and the non-retained tracer as in step (a), and comparing the simulated produced fluid concentration profiles of the retained chemical and the tracer with the the actual produced fluid concentration profiles from this step for an acceptable match, modifying as necessary the retention parameters;

(e) simulating additional cycles in the core until such time as the simulated produced fluid concentration profile for the retained chemical is essentially the same as the actual produced fluid concentration profile for the tracer from step (a);

(f) determining the amount of chemical retained within the contacted core volume by summing the amount of chemical retained in step (a) and the amounts of chemical retained in the simulated cycles in steps (d) and (e); and (g) extrapolating the amount of the chemical retained per unit volume from step (f) to the reservoir as a whole.

DESCRIPTION OF THE PREFERRED EMBODIMENTS

Reliable data concerning chemical retention in a reservoir is vital for designing the chemical flood within a reservoir. Such data are usually obtained from laboratory experiments involving chemical injection into core materials obtained from the reservoir. It is, however, difficult to extrapolate the data obtained from laboratory core floods to the reservoir as a whole because of the inability of the core flood to accurately simulate the complex fluid flow and chemical retention mechanisms that take place within the comparatively huge volume of a typical heterogeneous subterranean reservoir. Reliable data can be obtained from a multiwell pilot program wherein the actual chemicals are injected through and produced from a plurality of wells which penetrate a portion of the reservoir. Such a procedure is, however, very costly and quite time consuming and is almost certainly too expensive, typically on the order of several million dollars, to ever be able to be put to widespread use as a test for chemical retention. Laboratory core floods remain as the most economically attractive method for predicting chemical behavior within a reservoir. We have discovered a method to accurately predict reservoir chemical retention using core flood data. The procedure involves injecting a quantity of an aqueous chemical solution comprising both a "target" chemical and a non-retained tracer through the well into the core. The core is then shut-in for an effective period of time to satisfy chemical consumption in the effected core volume and is finally put on production while the produced fluids are monitored for the concentration of both the chemical and the tracer. Chemical retention values can then be determined by material balances on the injected and produced chemical and tracer. Our invention concerns novel refinements on this basic technique which markedly improve the accuracy and reliability of the chemical retention values which can be obtained by the method.

Figure 1:
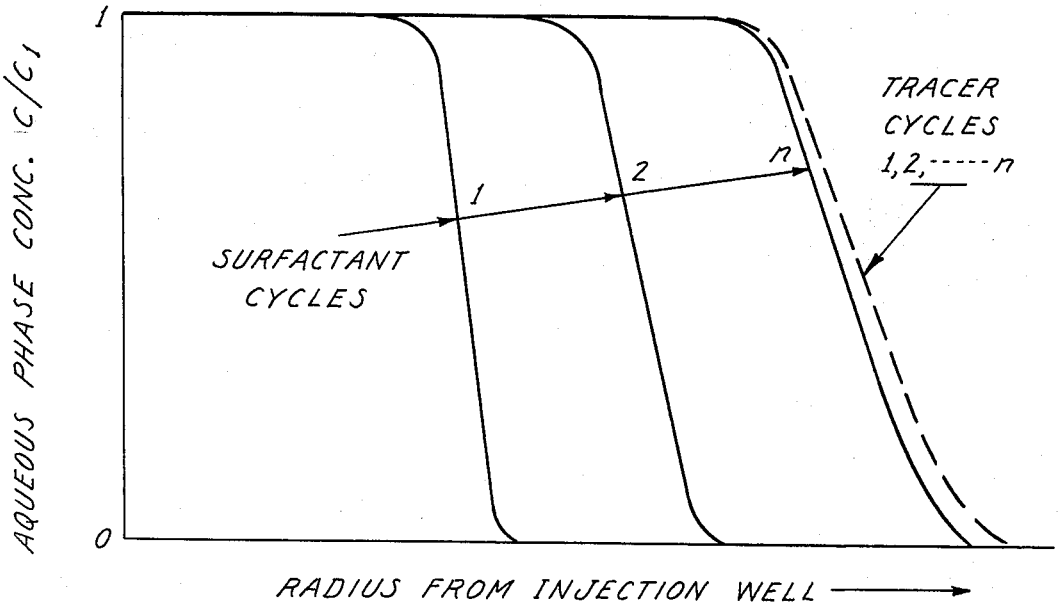
FIG. 1 is a graph of the produced fluid concentration profiles for both retained chemical and a non-retained tracer in a generalized series of cyclic tests in a core.

This cyclic chemical retention test employs a plurality of injection-soak-production cycles in which the same quantity of fluid is injected in each cycle and comprises a non-retained tracer and the chemical(s) for which reservoir retention data are desired. Since the same quantity of fluid is injected in each cycle and the tracer material is not retained, the core volume contacted by the tracer will be essentially the same in each cycle. However, the core volume contacted by an injected chemical(s) would be less than the core volume contacted by the non-retained tracer due to chemical retention. The core volume contacted by the chemical would eventually equalize with the tracer contacted volume after a number of repetitions of the injection-soak-production cycle as the chemical retention requirements within the effected core volume became satisfied. This is illustrated in FIG. 1. The point at which the chemical retention requirements are satisfied can be determined by comparing the concentration profiles for the produced tracer and chemical. This point is reached when the concentration profile of the produced chemical becomes essentially identical to that of the concentration profile of the produced tracer. A unit value for the chemical retention within the core can then be obtained by summing the amounts of chemical retained within the reservoir during each cycle and then dividing by the affected core volume.

In many cases however, the number of cycles necessary to reach this endpoint can be large enough to be considered to be impracticable from an economic viewpoint. In those cases where the number of cycles must be limited, the actual pore volume of the core that acts upon and retains the chemical is not equal to the injected volume of fluid in the cycle. A technique must be found which can determine the core volume that does retain the chemical. Our method utilizes a computer-implemented mathematical model which simulates the fluid flow and chemical interactions that take place within a core during a chemical flood. Initially, the tracer concentration profile obtained in the produced fluids at the end of the first cycle is utilized to obtained a dispersion parameter which describes the dispersion effects that take place for the non-retained tracer material. The retained chemical concentration profile from the produced fluids at the end of the first cycle is then history-matched to obtain the retention characteristics for the first cycle. This involves determination of dispersion and retention constants which are then utilized within the mathematical model to simulate a number of repetitions of the injection-soak-production cycle until the chemical retention endpoint is reached. Unit chemical retention values for the core are then determined as indicated above by summing the amounts of chemical retained during each cycle and dividing this total by the affected core volume. This information is then extrapolated to a reservoir as a whole by using conventional techniques. It is preferred that a series of actual injection-soak-production cycles be performed in the core to provide data useful in checking the accuracy of the derived dispersion and retention parameters used in the corresponding simulated injection-soak-production cycles and thereby determining the accuracy of the simulated results.

The mathematical model used in our invention is based on a versatile enhanced oil recovery program designed for the simulation of either linear or pattern water floods, surfactant floods or combination floods in either a single layer or a stratified reservoir. It is based on stream tube concepts and is designed to handle injection of solutions containing up to four chemicals. The model is designed to handle: (1) chemical transport mechanisms, accounting for dispersion, retention and partitioning effects; (2) incompressible flow of both water and oil phases within either the high tension (immiscible) or low tension (miscible) fluid flow regimes depending upon the chemical environment; and (3) non-Newtonian flow of an injected polymer solution and associated permeability reduction effects due to polymer retention within the reservoir matrices. The model as utilized herein simulates a core flooding.

The basic fluid flow and chemical transport equations used in the model are: Linear Two-Phase Incompressible Flow Equations:

$$-q_t \frac{\partial f_w}{\partial X} = \phi A \frac{\partial S_w}{\partial t}$$

where $$f_w = \frac{q_w}{q_t} = \frac{q_w}{q_w + q_o} = \frac{\frac{k_{rw}}{\mu_w}}{\frac{k_{rw}}{\mu_w} + \frac{k_{ro}}{\mu_o}}$$

$$f_w + f_o = 1.0$$
$$S_w + S_o = 1.0$$

where $f_w$=fractional water flow, $cm^3/cm^3$; $f_o$=fractional oil flow, $cm^3/cm^3$; x=distance, cm; A=cross-sectional area, $cm^2$; $S_w$=water saturation, $cm^3/cm^3$; $S_o$=oil saturation, $cm^3/cm^3$; t=time, sec; $q_w$=water flowrate, $cm^3/sec$; $q_o$=oil flow rate, $cm^3/sec$; $q_t$=total flow rate, $cm^3/sec$; $K_{rw}$=water relative permeability; $K_{ro}$=oil relative permeability; $\mu$=viscosity, mPa-s (cP).

Linear Dispersion-Retention-Partitioning Equations:

$$\frac{\partial}{\partial X} \frac{(D\partial C_w)}{\partial X} - \frac{q_t}{A} \frac{\partial}{\partial X} (f_w C_w + f_o C_o) = \phi \frac{\partial}{\partial t} (S_w C_w + S_o C_o) + (1 - \phi)\rho_r \frac{\partial C_{rm}}{\partial t}$$

$$\rho_r \frac{\partial C_{rm}}{\partial t} = K_1 (K_3 - C_{rm})C_w - K_2 C_{rm}$$

where $C_w$=concentration in the water phase, $mg/cm^3$; $c_o$=concentration in the oil phase, $mg/cm^3$; $\phi$=porosity, $cm^3/cm^3$; $\rho_r$=rock density, $gm/cm^3$; $C_{rm}$=chemical retention, mg/g of rock; $K_1$=kinetic adsorption rate constant, g/mg-sec; $K_3$=maximum equilibrium retention, mg/g; $K_2$=kinetic desorption rate constant, g/mg-sec.

The oil phase chemical concentration and dispersion coefficients are given as follows:

$$C_o = KC_w$$

$$D = \lambda(q_t)/A\phi = \lambda v$$

where D=dispersion coefficient, $cm^2/sec$; K=partition coefficient, dimensionless; $\lambda$=dispersion parameter, cm; v =interstitial velocity, cm/sec.

The high, low or intermediate tension flow behavior is influenced by the aqueous phase chemical and salt concentrations. The flow behavior is simulated by using appropriate relative permeability data. High tension oil-water relative permeability curves are the same as used for conventional water flood calculations. A provision is made to account for residual resistance due to polymer retention on the rock. The low tension relative permeabilities are similar to those used for miscible displacements. Modified Corey equations are used to determine relative permeability as follows:

$$K_{rw} = \frac{S_w - S_{wir}}{1 - S_{wir}}^{nw}$$

$$K_{ro} = \frac{S_o - S_{or}}{1 - S_{wir} - S_{or}}^{no}$$

where $S_{or}$=residual oil saturation, $cm^3/cm^3$; $S_{wir}$=irreducible water saturation, $cm^3/cm^3$; $n_o$=oil relative permeability exponent; $n_w$=water relative permeability exponent.

The exponents $n_w$ and $n_o$ approach unity, and $s_{or}$ approaches zero in the case of very low tension. The above relationships may be used for high or intermediate tension for which the exponents are greater than unity and $S_{or}>0$.

The model allows polymer viscosity to be a function of its aqueous phase concentration and shear rate. The apparent polymer of viscosity is related to shear rate at a given concentration, as reported by G. J. Hirasaki and G. A. Pope in the August 1974 issue of the *Society of Petroleum Engineering Journal* at page 237 entitled "Analysis of Factors Influencing Mobility and Adsorption in the Flow of Polymer Solution Through Porous Media." The finite difference scheme presented by J. T. Patton, K. H. Coates and J. T. Colagrove in the March 1971 issue of *The Society of Petroleum Engineering Journal* at pages 72-84 entitled "Prediction of Polymer Flood Performance" is used to solve for fluid saturations. The system of chemical transport equations is solved for a chemical concentrations in the aqueous, oil, and solid phases using the finite difference technique developed by A. Satter, Y. M. Shum, W. T. Adams and L. A. Davis in SPE Paper 6847 presented at the 52nd Fall Meeting of the SPE of AIME in Denver, Colo., October 9-12, 1977 entitled "Chemical Transport in Porous Media." The injection rate, which is allowed to vary during the life of a flood, is allocated among the stream tubes of various layers according to the fluid mobilities in the tubes based again on the Patton reference.

The computer program starts by calculating the cell and tube geometrical data based upon input streamline information and initializes the fluid saturations and chemical concentrations in the cells of the tubes of the various layers; then, starting at the initial time, computations are carried out by time steps. The sequence of calculations carried out includes mobilities in the cells, injection rate into a cell when pressure differential between the injector and producer is fixed or vice versa, followed by flowrates through the tubes. Then, considering one tube at a time, fluid saturations and fractional flows and concentrations of each chemical in the aqueous, oil or solid phases in the cells are computed. The output consists of oil, water and chemical production, fluid saturations, and chemical distributions in the reservoir at specified time intervals.

The operability of the mathematical simulator and the method of our invention was also verified in a field test utilizing a single well. The results of this field test ments form the basis for our related application Ser. No. 61,963 filed of even date. The method of our invention is illustrated in the following examples.

EXAMPLE 1

Cyclic retention tests were performed in a long Berea core. The experimental procedure consisted of: (1) saturation of the core with synthetic formation water (1-2 pore volumes, $V_p$, of 6000 parts per million, ppm, NaCl); (2) injection of crude oil (2-3 $V_p$) until irreducible water saturation is achieved; (3) flood core with synthetic formation water until residual oil saturation is established ($S_{or}$); (4) injection of 0.1 $V_p$ synthetic formation water containing KI tracer (274 ppm) at a rate of 1.52 m/day, while monitoring pressure; (5) allow core to soak for 20 hours; (6) injection of synthetic formation water into opposite end of core and backflow (about 1.5 $V_p$), monitor pressure, collect 5 cc samples up to 0.5 $V_p$ and 10 cc samples thereafter; (7) read volume of oil and water and transfer to sequentially labelled sample bottles which are analyzed at end of test; (8) repetition of procedure starting with step (4) using surfactant solution (a solution containing water, 6000 ppm NaCl, 21,700 ppm TRS 10-80—a petroleum sulfonate surfactant blend marketed by the Witco Chemical Co., 6000 ppm $Na_2CO_3$, and 1000 ppm STPP) containing KI tracer (274 ppm) for 3 cycles; (9) flush core with toluene to remove oil; (10) extract surfactant remaining in core with isopropyl alcohol and deionized water; (11) collect all effluent and analyze for oil content and surfactant content in both oil and water phases. The Berea sandstone core had the following characteristics; length 88.6 cm; diameter 5.1 cm, porosity 0.205; air permeability 249 md; density 2.65 gm/cc; initial $S_o$ 0.597; waterflood $S_{or}$ 0.351.

Figure 2:
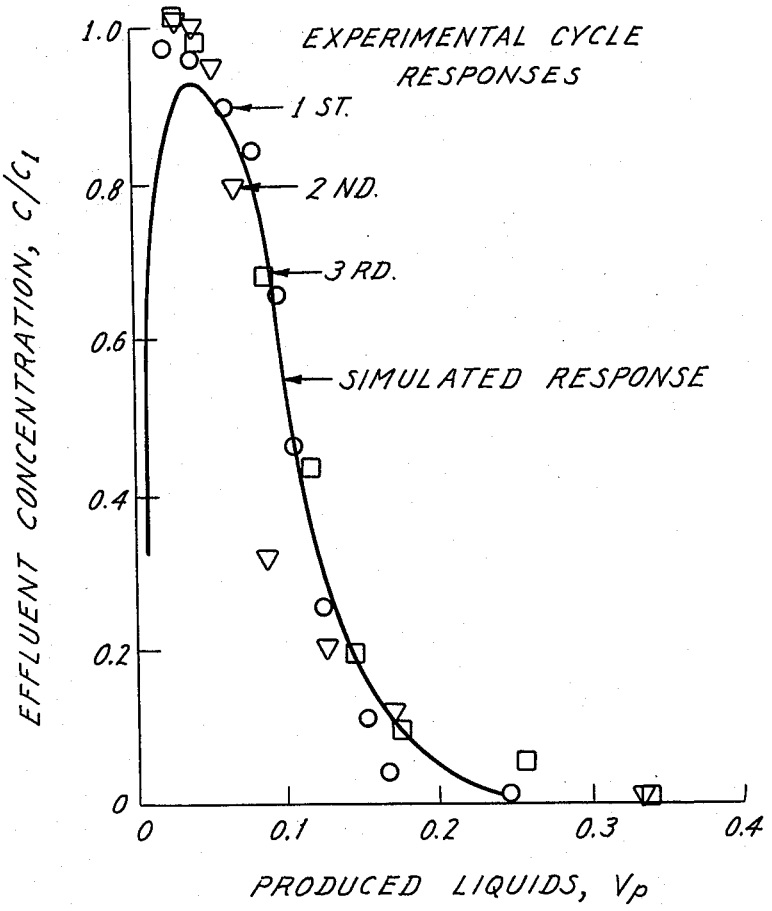
FIG. 2 is a graph of the produced tracer concentrations for a cyclic core flood test.
Figure 3:
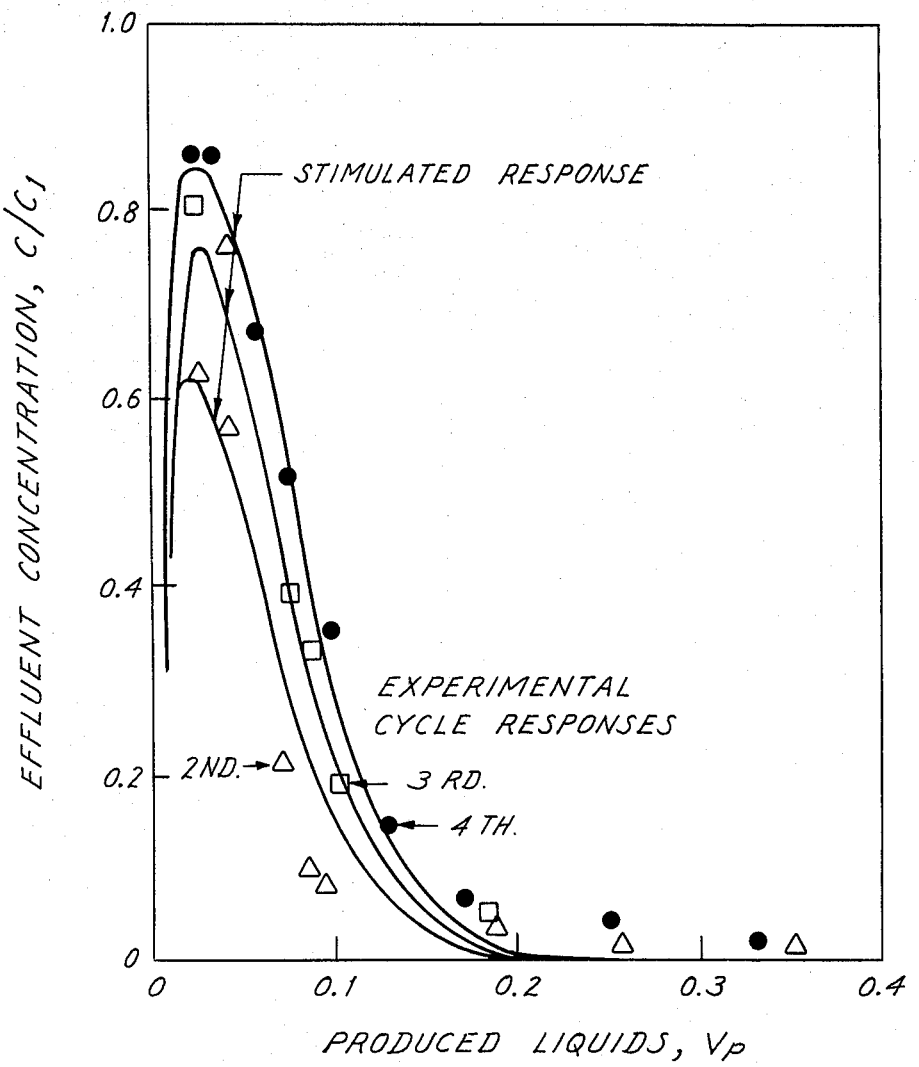
FIG. 3 is a graph of the produced surfactant (the retained chemical) concentrations for a cyclic core flood test.

The core was initially subjected to an injection-soak-production cycle using tracer alone. Surfactant-tracer solutions were utilized for the following three cycles. Produced tracer and surfactant concentrations are shown in FIG. 2 and FIG. 3 respectively. In each Figure, the simulated response is indicated by the solid curve while the actual experimental data are indicated by the individual points.

The amounts of tracer and surfactant produced from the core were calculated using their concentration in the effluent fluids. Table 1 represents a material balance on the KI tracer while Table 2 shows the corresponding results for the surfactant material.

TABLE 1

TRACER MATERIAL BALANCE

| Cycle | Injected KI, mg | Produced KI, mg | % error |
|---|---|---|---|
| 1 | 9.2 | 9.8 | 6.5 |
| 2 | 9.2 | 9.3 | 1.1 |
| 3 | 9.2 | 10.6 | 15.2 |
| Total | 27.6 | 29.7 | 7.6 (avg.) |

TABLE 2

SURFACTANT RETENTION

| Cycle | Surf. mg | Surf. mg | Surf. Retained (mg) Cycle | Surf. Retained (mg) Cumulative | Surf. Retained (mg) Cycle | Surf. Retained (mg) Cumulative |
|---|---|---|---|---|---|---|
| 2 | 840 | 395 | 445 | 445 | 0.76 | 0.70 |
| 3 | 840 | 613 | 227 | 672 | 1.15 | 1.19 |
| 4 | 840 | 711 | 129 | 801 | 1.38 | 1.53 |

The computer program was then used to simulate tracer and surfactant production responses in the cyclic tests. The simulated tracer response shown in FIG. 2 indicates a good match with the experimental data. Using the dispersion parameter (0.3 cm) obtained by simulating the produced tracer concentration, the program was used to history match the produced surfactant concentration from the second cycle test. Time dependent adsorption (0.01 g/mg-hr.) and equilibrium surfactant adsorption constants (2.5 mg/g rock) derived from this history-match were utilized to predict the produced surfactant concentration profiles for each of the successive cycles. The agreement between the experimental and simulated data is excellent as seen in FIG. 3.

EXAMPLE 2

Using another Berea core and the same crude oil and chemical-tracer system, an intermittent throughput flood was conducted for comparison with the cyclic retention method. This throughput method involved the injection of four pore volumes of surfactant and tracer solution into a long Berea core. Injection was interrupted at the end of each throughput pore volume to allow a soak period for chemical adsorption.

The experimental procedure was: (1) saturate the core with synthetic formation water (1-2 $V_p$); (2) inject crude oil until irreducible water saturation is reached (2-3 $V_p$), (3) flood core with synthetic formation water until residual oil saturation is reached (3 $V_p$); (4) inject 1.0 $V_p$ of surfactant-tracer solution at rate of 1.52 m/d monitor pressure and collect 5 cc samples up to 0.5 $V_p$ and 10 cc samples thereafter; (5) read volume of oil and water and transfer to sequentially labelled sample bottles which are analyzed at the end of the test; (6) soak core for about 34 hours; (7) repeat steps (4)-(6) for up to 4 $V_p$, continue only if final samples indicate necessity; (8) flush core with toluene to remove oil; (9) flush core with isopropyl alcohol and deionized water to recover the surfactant; (10) collect entire effluent and analyze. The Berea core had the following characteristics: length 90.0 cm; diameter 5.1 cm; porosity 0.217; air permeability 768 md; rock density 2.65 gm/cc; initial $S_o$ 0.641; waterflood $S_{or}$ 0.360.

Figure 4:
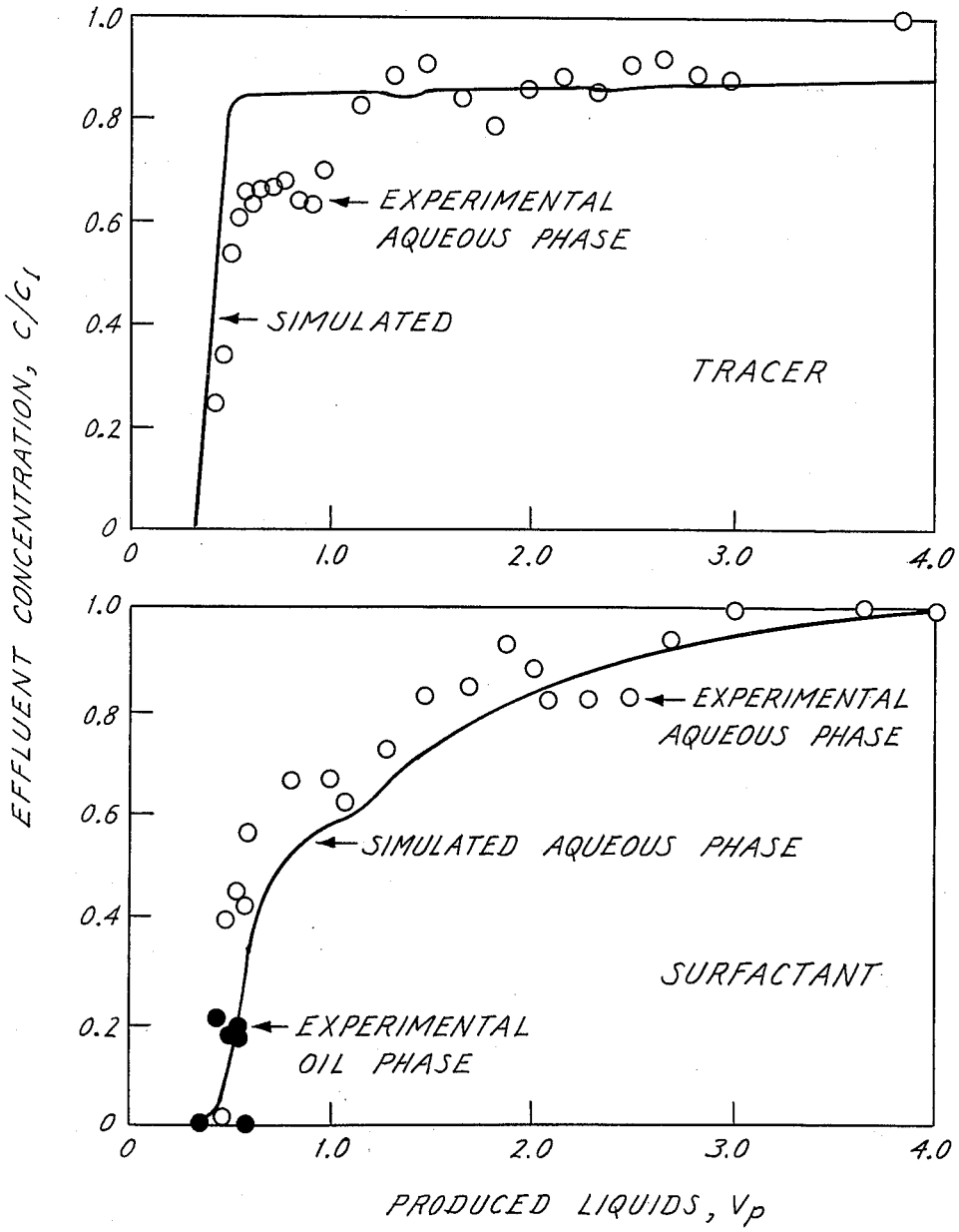
FIG. 4 shows produced tracer and surfactant concentrations for a throughput core flood test.

Tracer concentrations in the aqueous phase and surfactant concentrations in the aqueous and oil phases are shown in FIG. 4. A small amount of surfactant partitioning into the oil phase was observed. A close examination of the produced tracer concentration profile for the intermittent throughput flood revealed that, considering the unexpected by early tracer breakthrough, the entire pore volume of the core was not accessible to the injected fluid. This same conclusion is indicated by the fact that some 70% of the injected tracer concentration was detected at unit pore volume throughput as opposed to the 50% tracer concentration that would be expected from an idealized core with no inaccessible pore volume. It is thought that this inaccessible pore volume phenomenon in the core is an inherent effect of a miscible displacement process in the presence of high water saturations wherein microscopic blockages occur within the pore volumes possible due to oil banking-blocking effects.

Utilizing the computer program, a history match of the tracer and surfactant concentration profiles, water cut and oil recovery performances indicated that approximately 60% of the core pore volume was swept by the fluid. The calculated unit surfactant retention values are reported in Table 3 below. Since the surfactant concentrations in the residual oil and water present in the core were not directly known, the following assumptions were made: (1) aqueous phase surfactant concentration is given by an average of the input and output concentrations and (2) surfactant concentration in the oil is related to the concentration in the water by a partition coefficient. The coefficient used was the value obtained from the effluent concentrations in the oil and water at the end of the first pore volume of chemical injection into the core. Little or no oil was produced after the first pore volume, and the surfactant concentration in the oil could not be obtained. The surfactant retention values obtained by computer simulation in Table 3 are based upon the assumption of 60% accessible pore volume in the core. Other values used in the simulation were: low tension limit for surfactant concentration 6000 mg/kg; surfactant flood residual oil saturation 0.181; water-oil relative permeability exponents—high tension $n_w=2.0$, $n_o=6.0$, low tension $n_w=1.5$, $n_o=1.2$; surfactant partitioning, $C_o/C_w=0.5$. The simulated retention values were 21.9% higher than the experimental values, 2.35 mg/g rock vs. 1.68 mg/g rock. However this discrepancy is consistent with the simulated effluent aqueous phase surfactant concentration profile being lower than the experimental results and, indeed, not unexpected considering the assumptions involved in the calculations and the uncertainty in the inaccessible pore volume value used.

TABLE 3

SURFACTANT RETENTION

| Throughput Vp | Injected Surf. mg | Produced Surf. mg | Surf. Retained in Core Oil mg | Water mg | Rock mg | Surf. Retention mg/g rock Experimental | Simulated |
|---|---|---|---|---|---|---|---|
| 0.994 | 8,526 | 2,644 | 204 | 3515 | 2163 | 0.95 | 1.29 |
| 2.048 | 17,514 | 9,889 | 230 | 3971 | 3424 | 1.51 | 2.02 |
| 3.031 | 26,357 | 17,653 | 245 | 4214 | 4245 | 1.87 | 2.28 |
| 4.017 | 35,083 | 26,379 | 245 | 4214 | 4245 | 1.87 | 2.35 |

In the preceding preferred embodiments and accompanying example the injection-soak-production of a nonretained tracer material was utilized to construct a produced fluids concentration history curve depicting the response of a chemical that would not be retained by the core surfaces in which it came into contact during the injection-soak-production cycle. As explained above the information obtained from such a curve yields information vital to the practice of the method of our invention, namely the pore volume of core contacted and the retention parameter of the non-retained material. As discussed above, this produced fluid concentration curve for a non-retained tracer material will be identical in form to the produced fluid concentration curve of a chemical that is retained by the reservoir when a sufficient number of injection-soak-production cycles involving the retained chemical have been performed so that the retention demands of the core for the particular volume of injected chemical have been totally satisfied. It is therefore also possible to forego the injection of a nonretained tracer material in order to obtain the necessary curve and the information contained therein if the curve can be reliably obtained by other means. One such means would be to repeat the injection-soak-production cycle for the retained or target chemical a number of times until a point is reached where the last two produced chemical concentration curves are identical, thus signaling that the point of maximum retention of the chemical by the core has been reached. In another preferred embodiment the injection-soak-production cycle for the target chemical is repeated only a number of times sufficient to be able to accurately predict the final shape of the curve by conventional techniques.

The invention has been described in the two above examples by use of standardized Berea cores. In some instances it will be advisable to utilize cores taken from the reservoir itself rather than to attempt to correlate the rock properties of a Berea core to those of the reservoir. Additionally, it is preferable to utilize laboratory-prepared flooding fluids that are as nearly identical to the actual reservoir fluids (i.e. field brine and crude oil) as is possible. In any event the method of the invention remains the same.

The invention and the best mode contemplated for applying that invention have been described. It is to be understood that the foregoing is presented for the purpose of illustration and that other means and techniques can be employed without departing from the true scope of the invention as defined in the following claims.

We claim:

1. A method for determining the amount of a chemical that is retained within a core undergoing a chemical flooding operation comprising:

(a) conducting a first injection-soak-production cycle in a core with a volume of a fluid which comprises the retained chemical and a non-retained tracer material;

(b) obtaining from a produced fluids concentration profile of the tracer the core volume contacted and a dispersion parameter describing the dispersion effects for a non-retained material within the core;

(c) obtaining retention parameters for the retained chemical by history-matching the actual produced fluids concentration profile of the retained chemical with a simulated produced fluids concentration profile of the retained chemical for this cycle obtained from a chemical flood mathematical model of the core;

(d) simulating within the chemical flood mathematical model at least one more injection-soak-production cycle in the well utilizing a fluid of the same volume and comprising the same concentration of the retained chemical as in step (a) until such time as the simulated produced fluid concentration profile of the chemical is essentially the same as the actual produced fluid concentration profile of tracer from step (a);

(e) determining the amount of chemical retained within the contacted core volume by summing the amount of the chemical retained in step (a) and the amounts of the chemical retained in the simulated cycles of step (d); and (f) determining the amount of the chemical that is retained per unit volume by those portions of the core undergoing the chemical flood by dividing the summed amount of chemical retained in step (e) by the core volume contacted in the cyclic test from step (a).

2. The method of claim 1 comprising an additional step wherein produced fluids concentration profiles are obtained from a second actual injection-soak-production cycle conducted in the core which are compared with the corresponding simulated produced fluids concentration profiles for the purpose of verifying the accuracy of the simulations.

3. The method of claim 2 comprising an additional step wherein, if the actual second cycle produced fluids concentration profiles differ from the corresponding simulated profiles by more than an acceptable level, the retention and dispersion parameters from steps (b) and (c) of claim 1 are adjusted in order to bring the differences between the actual second cycle profiles and the corresponding simulated profile to within acceptable levels.

4. The method of claim 1 wherein the retained chemical comprises a combination of a least two different chemical compounds.

5. In a petroleum recovery method wherein a chemical is injected into an underground petroleum reservoir, the chemical being of a type which will be retained to some extent within the reservoir, wherein the chemical is injected in an amount in excess of that which would be retained within the reservoir wherein the retained amount is determined by a method comprising:

(a) conducting a first injection-soak-production cycle in a core with a volume of a fluid which comprises the retained chemical and a non-retained tracer material;

(b) obtaining from a produced fluids concentration profile of the tracer the core volume contacted and a dispersion parameter describing the dispersion effects for a non-retained material within the core;

(c) obtaining retention parameters for the retained chemical by comparing the produced fluids concentration profile of the retained chemical with a simulated produced fluids concentration profile of the retained chemical for this cycle obtained from a chemical flood mathematical model of the core;

(d) simulating within the chemical flood mathematical model at least one more injection-soak-production cycle in the well utilizing a fluid of the same volume and comprising the same concentration of the retained chemical as in step (a) until such time as the simulated produced fluid concentration profile of the chemical is essentially the same as the actual produced fluid concentration profile of tracer from step (a);

(e) determining the amount of chemical retained within the contacted core volume by summing the amount of the chemical retained in step (a) and the amounts of the chemical retained in the simulated cycles of step (d);

(f) determining the amount of the chemical that is retained per unit volume by those portions of the core undergoing the chemical flood by dividing the summed amount of chemical retained in step (e) the core volume contacted in the cyclic test from step (a); and (g) determining the amount of chemical retained within the reservoir by calculation from the value obtained from step (f).

6. The method of claim 5 comprising an additional step wherein produced fluids concentration profiles are obtained from a second actual injection-soak-production cycle conducted in the core which are compared with the corresponding simulated produced fluids concentration profiles for the purpose of verifying the accuracy of the simulations.

7. The method of claim 6 comprising an additional step wherein, if the actual second cycle produced fluids concentration profiles differ from the corresponding simulated profiles by more than an acceptable level, the retention and dispersion parameters from steps (b) and (c) of claim 1 are adjusted in order to bring the differences between the actual second cycle profiles and the corresponding simulated profile to within acceptable levels.

8. The method claim 5 wherein the core is taken from the reservoir.

9. The method of claim 5 wherein the retained chemical comprises a combination of at least two different chemical compounds.

* * * * *